US006371248B1

(12) United States Patent
Cholinski

(10) Patent No.: US 6,371,248 B1
(45) Date of Patent: Apr. 16, 2002

(54) DRIVE UNIT FOR ELEVATORS

(75) Inventor: Andrzej Cholinski, Ebikon (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/448,672

(22) Filed: Nov. 24, 1999

(30) Foreign Application Priority Data

Dec. 14, 1998 (EP) ..... 98811223

(51) Int. Cl.[7] ..... B66B 11/04; B66B 11/08

(52) U.S. Cl. ..... 187/254; 187/250; 187/277; 187/288; 310/258; 254/362; 254/378

(58) Field of Search ..... 187/250, 251, 187/254, 258, 277, 289, 288; 254/362, 236, 378; 310/258

(56) References Cited

U.S. PATENT DOCUMENTS

| | | | | | |
|---|---|---|---|---|---|
| 1,326,984 | A | * | 1/1920 | Sproul | 187/254 |
| 3,695,399 | A | * | 10/1972 | Laing | 187/254 X |
| 4,287,551 | A | * | 9/1981 | Watanabe | 187/277 X |
| 4,355,785 | A | * | 10/1982 | Tosato et al. | 254/362 |
| 4,434,973 | A | * | 3/1984 | Desplats | 254/362 X |
| 4,739,969 | A | | 4/1988 | Eckersley et al. | |
| 5,007,505 | A | * | 4/1991 | Lindegger | 187/254 |
| 5,148,893 | A | | 9/1992 | Vertesy et al. | |
| 5,167,400 | A | * | 12/1992 | Gazel-Anthoine | 254/362 X |
| 5,202,539 | A | * | 4/1993 | Lamb | 187/254 |
| 5,244,060 | A | * | 9/1993 | Tanaka et al. | 187/261 |

FOREIGN PATENT DOCUMENTS

| | | | | | |
|---|---|---|---|---|---|
| DE | 44 278 | | 1/1966 | | |
| DE | 196 34 629 | | 8/1997 | | |
| EP | 0 676 357 | | 10/1995 | | |
| GB | 396445 | A * | 8/1933 | | 187/254 |
| GB | 2131381 | A * | 6/1984 | | 254/236 |

* cited by examiner

*Primary Examiner*—Eileen D Lillis
*Assistant Examiner*—Thuy V. Tran
(74) *Attorney, Agent, or Firm*—MacMillan, Sobanski & Todd, LLC

(57) ABSTRACT

A drive unit has a traction sheave mounted on an end of a drive shaft supported by a bearing that is mounted on an extension of a bearing plate that is part of the motor casing. The traction sheave has an extension that serves as a brake drum. Mounted between the traction sheave and the casing, the brake drum together with first brake arms, second brake arms, first electromagnets, second electromagnets, first compression springs and second compression springs form the braking device of the drive unit. On a top of the bearing plate is a first arm linkage and at the bottom of the bearing plate is a second arm linkage. The force of the first compression spring is transmitted to the brake drum by the first brake arm, the required friction force on the brake drum being generated by a first brake lining mounted on a first brake shoe. The friction force on the second half of the brake is generated analogously. To release the brake the electromagnets are activated, these overcoming the forces of the compression springs and lifting the brake shoes together with the brake linings off brake drum.

11 Claims, 2 Drawing Sheets

DRIVE UNIT FOR ELEVATORS

BACKGROUND OF THE INVENTION

The invention relates to a drive unit for elevators consisting of a motor mounted in a casing, the motor driving a traction sheave via a drive shaft, there being a braking device to hold the traction sheave.

From the German patent specification DD 44 278 an electric elevator motor has become known which has a traction sheave and brake drum which are fastened together. The traction sheave and brake drum are mounted outside both the motor casing and the bearing closest to the motor on the free end of a shaft in an overhung manner. The traction sheave and the brake drum can be constructed in one piece. The brake, which has two shoes, consists of an actuating device, brake arms, and brake shoes, the actuating device being fastened on the outside of the casing of the motor. To support the heavy loads occurring on the side closest to the traction sheave there is a bearing plate and a bearing for heavy loads.

A disadvantage of the known device is that the overhung arrangement of the traction sheave and brake drum necessitate an expensive bearing plate and bearing for heavy loads. A further disadvantage is having the brake arms and brake shoes arranged at the sides, which increases the diameter of the drive unit.

SUMMARY OF THE INVENTION

The present invention concerns a drive unit with a narrow construction for use with an elevator.

The advantages resulting from the invention relate mainly to the fact that the drive unit is narrow in the direction at right angles to the drive shaft, and that the narrow construction makes it possible for the drive unit to be built into an elevator hoistway, for example in the space between the path of travel of the car and the wall of the hoistway. A further advantage lies in the common support of the traction sheave and drive shaft. There is no unsupported free end of a shaft, the traction sheave being supported directly on the bearing plate. As a result, bending forces on the drive shaft can be avoided.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
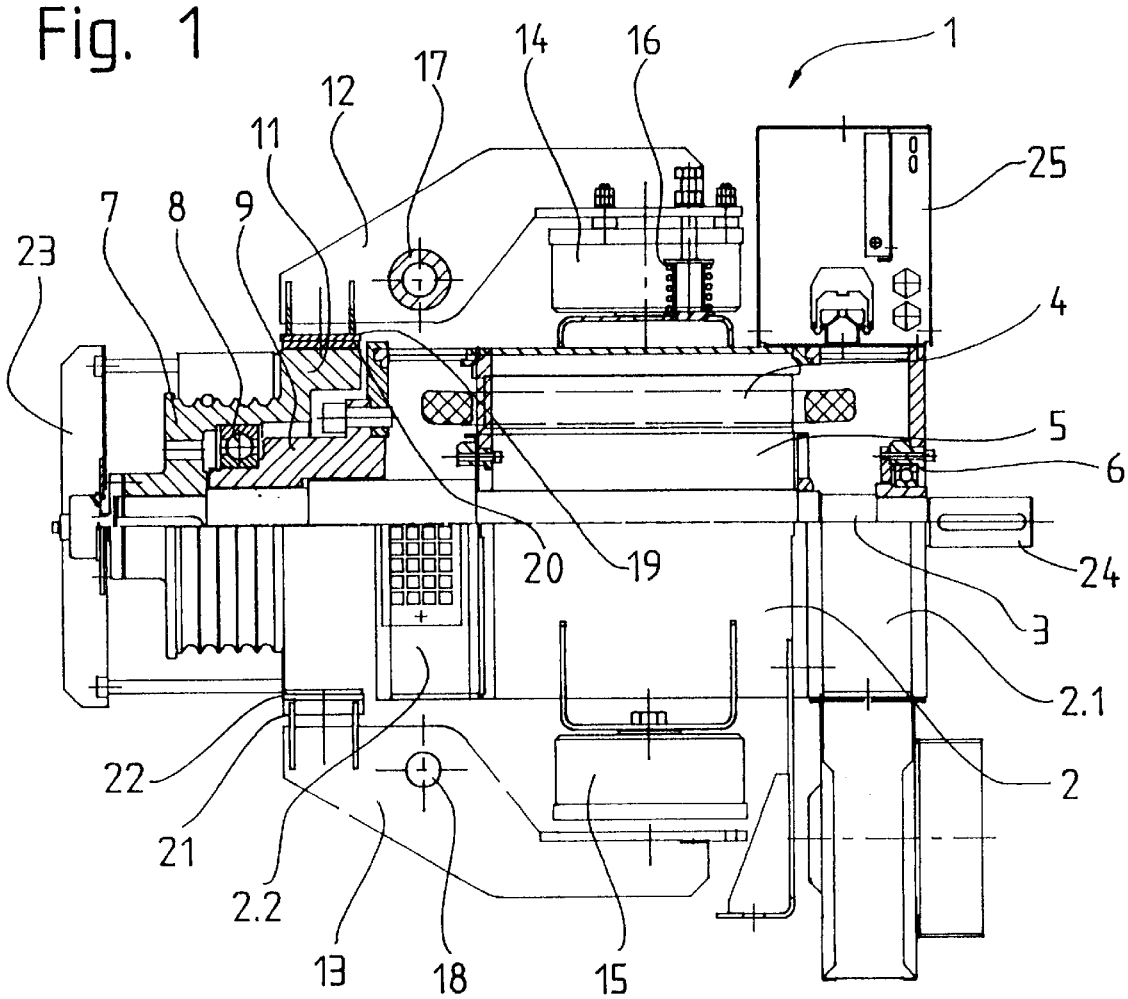
FIG. 1 is a side elevation view of a drive unit in accordance with the present invention having a motor, a traction sheave, and a braking device.
Figure 2:
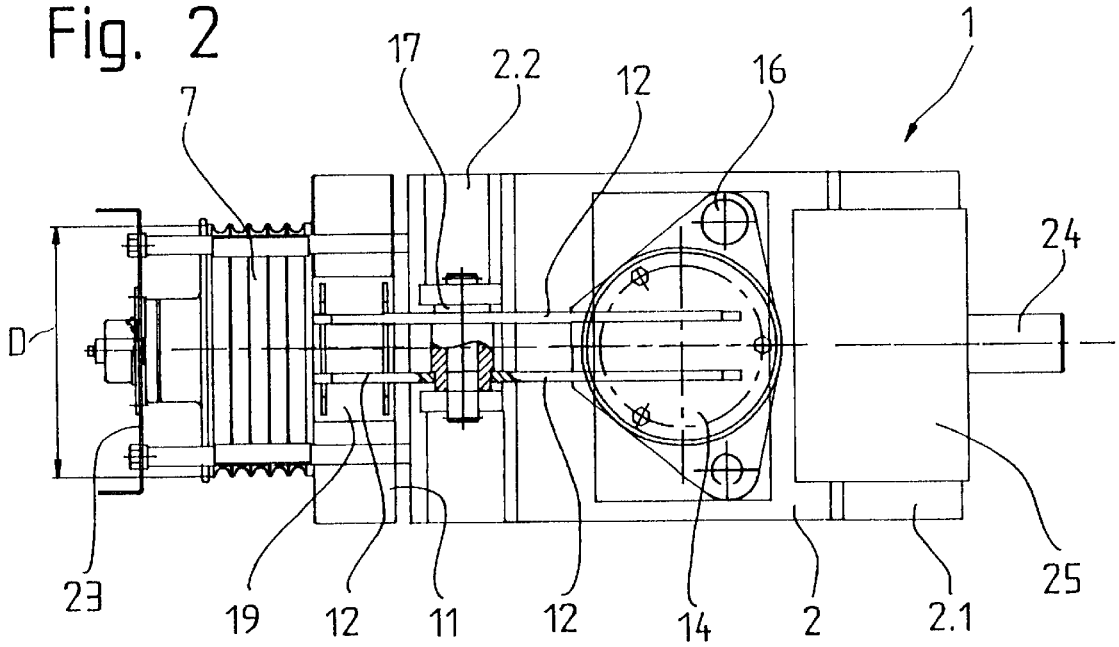
FIG. 2 is top plan view of the drive unit shown in the FIG. 1.
Figure 3:
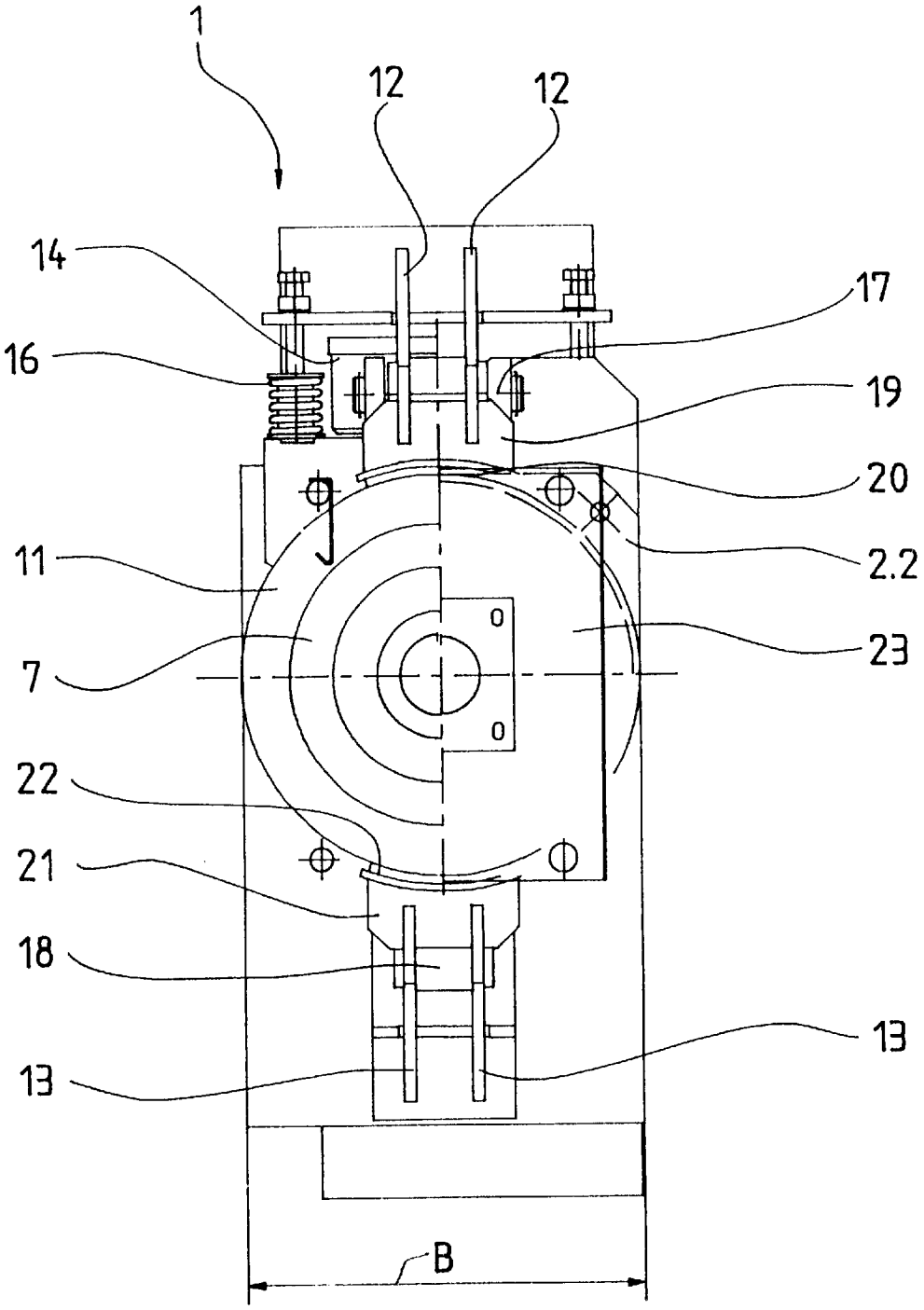
FIG. 3 is a traction sheave end view of the drive unit shown in the FIG. 1.

In the FIGS. 1 to 3, there is shown a drive unit 1 which consists in essence of a casing 2, a drive shaft 3 extending through the casing 2, a stator 4 fastened inside the casing 2, and a rotor 5 fastened to the drive shaft 3. The stator 4 and the rotor 5 form the drive motor. The drive shaft 3 is supported at one end by a first bearing 6 that is mounted in a first bearing plate 2.1 that is a constituent part of the casing 2.

Mounted at an opposite, free end of the drive shaft 3 is a traction sheave 7 over which ropes (not shown in the drawing) that support and move an elevator car and a counterweight are slung. The traction sheave 7 or, more specifically, the other free end of the drive shaft 3, is supported by a second bearing 8 that is mounted on an extension piece 9. The extension piece 9 is part of a second bearing plate 2.2 that is a constituent part of the casing 2. The traction sheave 7 has an extension that serves as a brake drum 11. The brake drum 11 extends radially and axially from an end of the traction sheave 7 adjacent the second bearing plate 2.2. Mounted between the traction sheave 7 and the casing 2, the brake drum 11, together with a pair of first brake arms 12, a pair of second brake arms 13, a pair of first electromagnets 14, a pair of second electromagnets 15, a pair of first compression springs 16, and a pair of second compression springs (not shown in the drawing) form the braking device of the drive unit 1. On the top of the second bearing plate 2.2 is a first arm linkage 17, and at the bottom of the second bearing plate 2.2 is a second arm linkage 18. Each first brake arm 12 is mounted in a pivoting manner on the first arm linkage 17 and each second brake arm 13 is mounted in a pivoting manner on the second arm linkage 18. The force of the first compression spring 16 is transmitted to the brake drum 11 by means of the first brake arm 12, the required friction force on the brake drum 11 being generated by a first brake lining 20 mounted on a first brake shoe 19. The force of the second compression spring is transmitted to the brake drum 11 by means of the second brake arm 13, while a second brake lining 22 mounted on a second brake shoe 21 generates the required friction force on the brake drum 11. To release the brake, the electromagnets 14 and 15 are activated, these overcoming the forces of the compression springs and lifting the brake shoes 19 and 21 together with the brake linings 20 and 22 off the brake drum 11. Instead of the electromagnets 14 and 15 hydraulic lifting cylinders can be provided.

A rope retainer 23 mounted at the traction sheave end prevents the ropes from jumping off the traction sheave 7. On the opposite end of the drive shaft 3 from the traction sheave 7 is a shaft stub 24 that, for example, drives a sensor which registers the rotation of the drive shaft 3. There is also on the top of the casing 2 a connection box 25 for the electric power supply to the drive unit 1.

By means of the bearing arrangement shown for the traction sheave 7 with integral brake drum 11, and the bearing arrangement of the drive shaft 3, the forces are transferred to the second bearing plate 2.2 at the point at which they arise, thereby avoiding the bending forces that occur at the free ends of shafts. A further advantage is the arrangement of the brake on the top and bottom of the drive unit. A width B of the drive unit is determined only by the size of the motor, comprising the stator 4 and rotor 5, there being no additional structures on the sides which increase the width B. A diameter D of the traction sheave 7 is smaller than, or the same as, the width B of the drive unit 1.

The exemplary embodiment illustrated relates to a gearless drive unit. The traction sheave with braking device and its bearing arrangement according to the invention can also be used, for example, on drive units with gears. Furthermore, instead of the drum brake there can be a disk brake, the extension to the traction sheave 7 in this case having the form of a disk, and the brake shoes 19 and 21 being arranged at the two sides of the brake disk on the top and/or the bottom of the casing 2.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A drive unit for elevators comprising:

a motor having a casing and a drive shaft, said drive shaft being rotatably supported in said casing and having a free end extending from one end of said casing;

a traction sheave mounted on said free end of said drive shaft for rotation with said drive shaft;

a bearing mounted on an exterior of an extension of said one end of said casing and rotatably supporting said traction sheave and said free end of said shaft, said bearing and said traction sheave being axially aligned for supporting a load applied to the traction sheave; and a braking device for preventing rotation of said traction sheave, said braking device including a portion of said traction sheave encircling said extension between said bearing and said one end of said casing to minimize a length of the drive unit.

2. The drive unit according to claim 1 wherein said traction sheave is supported in a bearing plate of said casing in which said bearing is mounted, said portion of said traction sheave being an extension forming one of a brake drum and a brake disk of said braking device.

3. The drive unit according to claim 1 wherein said braking device includes at least a pair of brake arms pivotally mounted on said casing, actuating means coupled to a first end of each said brake arms for pivoting a second end of each of said brake arms into and out of frictional engagement with said portion of said traction sheave.

4. The drive unit according to claim 3 including a brake shoe carrying a brake lining attached to said second end of each of said brake arms, said actuating means moving said brake linings into frictional engagement with said portion of said traction sheave.

5. The drive unit according to claim 3 wherein one of said brake arms is pivotally mounted on a top of said casing and the other end of said brake arms is pivotally mounted on a bottom of said casing.

6. The drive unit according to claim 3 wherein actuating means includes spring means for pivoting said second end of each of said brake arms into frictional engagement with said portion of said traction sheave.

7. The drive unit according to claim 3 wherein said actuating means includes electromagnet means for pivoting said second end of each of said brake arms out of frictional engagement with said portion of said traction sheave.

8. The drive unit according to claim 1 wherein said casing has a relatively narrow width and said traction sheave has a diameter no larger than the width of said casing.

9. A drive unit for elevators comprising:

a motor having a casing and a drive shaft, said drive shaft being rotatably supported in said casing and having a free end extending from one end of said casing;

a traction sheave mounted on said free end of said drive shaft for rotation with said drive shaft, said traction sheave having an extension portion and a diameter no larger than a width of said casing;

a bearing mounted on an exterior of a reduced diameter extension at said one end of said casing and rotatably supporting said traction sheave; said extension portion of said traction sheave being positioned between said bearing and said one end of said casing; and a braking device for preventing of said traction sheave, said braking device including said extension portion of said traction sheave, at least one brake arm pivotally mounted on a top of said casing and at least another brake arms pivotally mounted on a bottom of said casing, and actuating means coupled to a first end of each of said brake arms for pivoting a second end of each of said brake arms into and out of frictional engagement with said extension portion of said traction sheave whereby the drive unit can be mounted in a space between a path of travel of an elevator car and a wall of an elevator hoistway.

10. A drive unit for elevators comprising:

a motor having a casing with a reduced diameter extension at one end;

a drive shaft rotatably supported in said casing and having a free end extending from said extension;

a traction sheave mounted on said free end of said drive shaft for rotation with said drive shaft;

a bearing mounted on an exterior of said extension and rotatably supporting said traction sheave and said free end of said shaft; and a braking device for preventing rotation of said traction sheave, said braking device including a portion of said traction sheave encircling said extension between said bearing and said one end of said casing.

11. The drive unit according to claim 10 wherein said casing has a relatively narrow width and said traction sheave including said braking device portion has a diameter no larger than the width of said casing.

* * * * *